US007488266B2

(12) United States Patent
Tucker, Jr. et al.

(10) Patent No.: US 7,488,266 B2
(45) Date of Patent: Feb. 10, 2009

(54) LACROSSE STICK HAVING A DOWNWARDLY CANTED HANDLE AND AN UPWARDLY CANTED HEAD

(75) Inventors: Richard B. C. Tucker, Jr., Baltimore, MD (US); David Reeb, Columbia, MD (US); Katelyn Marie Bedwell, Baltimore, MD (US)

(73) Assignee: STX, LLC, Baltimore, MD (US)

( * ) Notice: Subject to any disclaimer, the term of this patent is extended or adjusted under 35 U.S.C. 154(b) by 180 days.

(21) Appl. No.: 11/073,750

(22) Filed: Mar. 8, 2005

(65) Prior Publication Data

US 2006/0205542 A1 Sep. 14, 2006

(51) Int. Cl.
*A63B 59/02* (2006.01)
*A63B 65/12* (2006.01)

(52) U.S. Cl. ..... 473/513; D21/724

(58) Field of Classification Search ..... 473/505, 473/513, 512; D21/724
See application file for complete search history.

(56) References Cited

U.S. PATENT DOCUMENTS

| | | | | |
|---|---|---|---|---|
| 1,459,389 | A | 6/1923 | Brown | |
| 2,710,753 | A * | 6/1955 | Lockwood | 473/513 |
| 2,935,323 | A | 5/1960 | Cummings | |
| 3,507,495 | A | 4/1970 | Tucker et al. | |
| 3,545,755 | A | 12/1970 | Owada | |
| 3,822,062 | A | 7/1974 | Tucker et al. | |
| 4,034,984 | A | 7/1977 | Crawford et al. | |
| 4,037,841 | A | 7/1977 | Lewis | |
| 4,038,719 | A | 8/1977 | Bennett | |
| 4,045,026 | A | 8/1977 | Gillespie et al. | |
| D248,679 | S | 7/1978 | Rule | |
| 4,138,111 | A | 2/1979 | Rule | |
| 4,147,348 | A | 4/1979 | Lee | |
| 4,206,918 | A | 6/1980 | Lewis | |
| D263,248 | S | 3/1982 | Brine, Jr. | |
| 4,351,528 | A | 9/1982 | Duplin | |
| D273,601 | S | 4/1984 | Lewis, Jr. et al. | |
| 4,544,157 | A | 10/1985 | Curtis | |
| 4,657,260 | A | 4/1987 | Brine | |

(Continued)

FOREIGN PATENT DOCUMENTS

| | | |
|---|---|---|
| CA | 1273662 | 9/1990 |

(Continued)

OTHER PUBLICATIONS

Committee Meeting Minutes, May 15, 1983, Hall of Fame.

(Continued)

*Primary Examiner*—Gene Kim
*Assistant Examiner*—M Chambers
(74) *Attorney, Agent, or Firm*—Paul, Hastings, Janofsky & Walker LLP

(57) ABSTRACT

A lacrosse stick having a downwardly canted handle and an upwardly canted head. In an embodiment, the handle can comprise a main portion and a dowel portion. The main portion can have a main portion axis and the dowel portion can have a dowel portion axis. The dowel portion axis can be disposed downwardly at a first angle to the main portion axis. The head can comprise a throat portion and a frame portion. The frame portion can be upwardly canted with respect to the throat portion, when viewed from a side elevation.

27 Claims, 9 Drawing Sheets

U.S. PATENT DOCUMENTS

| | | | | | |
|---|---|---|---|---|---|
| 4,659,080 | A | | 4/1987 | Stoller | |
| 4,739,994 | A | | 4/1988 | Lewis | |
| D297,963 | S | | 10/1988 | Tucker et al. | |
| 4,940,243 | A | | 7/1990 | Tucker et al. | |
| D318,509 | S | | 7/1991 | Naumburg, Jr. | |
| 5,035,434 | A | | 7/1991 | Taylor et al. | |
| 5,037,112 | A | | 8/1991 | Brine et al. | |
| 5,048,843 | A | * | 9/1991 | Dorfi et al. | 473/513 |
| 5,054,790 | A | | 10/1991 | Brine, III et al. | |
| 5,067,726 | A | | 11/1991 | Brine, III et al. | |
| 5,080,372 | A | | 1/1992 | Brine, III et al. | |
| D331,086 | S | | 11/1992 | Brine, III et al. | |
| 5,290,039 | A | | 3/1994 | Cornelio | |
| 5,494,297 | A | | 2/1996 | MacNeil | |
| 5,566,947 | A | | 10/1996 | Tucker et al. | |
| 5,568,925 | A | * | 10/1996 | Morrow et al. | 473/513 |
| D376,183 | S | | 12/1996 | Morrow et al. | |
| 5,651,549 | A | | 7/1997 | Dill et al. | |
| 5,651,744 | A | | 7/1997 | Millon et al. | |
| 5,935,026 | A | * | 8/1999 | Dill et al. | 473/513 |
| 6,066,056 | A | * | 5/2000 | Morrow | 473/513 |
| 6,283,879 | B1 | | 9/2001 | Eden et al. | |
| RE37,894 | E | | 10/2002 | MacNeil | |
| 6,561,932 | B2 | * | 5/2003 | Morrow et al. | 473/513 |
| RE38,216 | E | | 8/2003 | Morrow et al. | |
| 6,916,259 | B2 | * | 7/2005 | Kohler et al. | 473/513 |
| 6,921,347 | B1 | * | 7/2005 | Morrow et al. | 473/513 |

FOREIGN PATENT DOCUMENTS

| | | |
|---|---|---|
| CA | 2322830 | 9/1999 |

OTHER PUBLICATIONS

Victory Cross sales literature (date and status publication unknown).
Excerpt of NCAA Lacrosse 2005 Men's Rules, Rules 1 and 5-5, Jan. 2005.
deBeer Phantom lacrosse stick with offset shaft, http://www.e-lacrosse.com/2001/debeer/1.html, 2001, pp. 1-7.
deBeer Phamtom Men's Complete Lacrosse Stick, http://www.sk8.co.nz/DeBeer-Phantom-Mens-Complete-Lacrosse-Stick-P4159C1310.aspx, (circa 2002), pp. 1-2.
deBeer Phantom, LaxShopper, 2002, pp. 1-2.
deBeer Sticks sales literature showing deBeer Phantom lacrosse head (circa 2002).
deBeer sales literature, The Phantom introducing T.O.S. transfer offset system (circa 2002).
deBeer sales literature, The Phantom introducing T.O.S. transfer offset system showing full length side view, (circa 2002).
Excerpt of STX Lacrosse 97 catalog, CO2 R-Force composite shown at p. 4-5, 1997.

* cited by examiner

LACROSSE STICK HAVING A DOWNWARDLY CANTED HANDLE AND AN UPWARDLY CANTED HEAD

BACKGROUND

1. Field of the Invention

The present invention relates generally to lacrosse sticks, and more particularly, to a lacrosse stick having a downwardly canted handle and an upwardly canted head.

2. Background of the Invention

FIG. 1 illustrates a conventional lacrosse stick 100 having a handle 102 shown in dotted lines and a double-wall synthetic head 104. Head 104 comprises a throat portion 105 and a frame portion 109. Frame portion 109, which is generally V-shaped in this example, comprises a stop member 114, sidewalls 108 and 110 joining stop member 114, and a transverse wall (or "scoop") 112 joining the sidewalls at their ends opposite stop member 114. As shown, handle 102 connects to throat portion 105 and abuts stop member 114. A screw or other fastener placed through opening 107 secures handle 102 to head 104.

For traditionally-strung pockets (which have thongs and string instead of mesh), thongs (not shown) made of leather or synthetic material extend from upper thong holes 116 in transverse wall 112 to lower thong holes 118 in stop member 114. In some designs, such as the design shown in FIG. 1, upper thong holes 116 are located on tabs 117 of the scoop 112. On other designs, upper thong holes 116 are located directly on the scoop 112. FIG. 1 shows four pairs (116, 118) of thong holes that accept four thongs. To complete the pocket web, the thongs have nylon strings threaded around the thongs and string laced through string holes 120 in sidewalls 108 and 110, forming any number of diamonds (crosslacing). Finally, one or more throwing or shooting strings extend transversely between the upper portions of sidewalls 108 and 110, attaching to throwing string holes 124 and a string laced through string holes 122. The typical features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

As shown in FIG. 1, the traditional means for affixing head 104 to handle or shaft 102 involves sliding shaft 102 into throat portion 105 of head 104 and securing head 104 to shaft 102 with a screw or similar fastener placed in opening 107. In this configuration, the axis of handle 102 and the axis of throat portion 105 are coincidental. In FIG. 1, throat portion 105 provides a female connection (e.g., a socket) that receives shaft 102. Alternatively, in addition to or in place of the female connection, throat portion 105 can provide a male plug that fits within the bore of shaft 102, as is disclosed, for example, in U.S. patent application Ser. No. 10/630,856, filed Jul. 31, 2003, which is herein incorporated by reference in its entirety.

When double-wall synthetic lacrosse heads were first introduced, the early designs featured straight handles and straight heads, when viewed from a side elevation facing a sidewall of the head. In other words, the lacrosse head remained largely in line with the axis of the handle. Since those early designs, however, the trend has been to lower the lacrosse head below the handle axis. Lowering the head can enable better ball control and provide a player with an indication of the orientation of the lacrosse head, which results from the uneven weight distribution relative to the handle axis in directions radial to the handle axis.

Despite these advantages, the lacrosse sticks having lowered heads can also introduce undesirable ball handling characteristics because the ball is positioned a greater distance below the shaft axis and must travel a greater distance to release from the head. Traditionally, designers have lowered heads either by reshaping the handle or by lowering the sidewalls adjacent to the throat portion. In either case, the reconfiguration positions the ball a greater distance from the shaft axis. Compounding this problem, the reconfiguration can cause the ball to come to rest in a rear head position (i.e., more toward the stop member). This rear head position, combined with the greater travel, can create difficulties in releasing the ball from the head, and can therefore hinder a player's ability to execute quick and accurate shots and passing.

SUMMARY OF THE INVENTION

An embodiment of the present invention provides a lacrosse stick having a downwardly canted handle and an upwardly canted head. As used herein, downwardly and upwardly refer to vertical directions when viewed from a side elevation of a lacrosse stick facing a sidewall of the lacrosse head. FIG. 2A illustrates this view. As also used herein, canted refers to the quality of departing from a straight line, such as departing from a horizontal line drawn in FIG. 2A (e.g., line 210). In the context of the present invention, a canted handle has a portion that departs from the axis of another portion when viewed from a side elevation. Likewise, a canted head has a portion that departs from the axis of another portion when viewed from a side elevation.

In an embodiment of the present invention, the handle can comprise a main portion and a dowel portion. The main portion can have a main portion axis and the dowel portion can have a dowel portion axis. The dowel portion axis can be disposed downwardly at a first angle to the main portion axis. The head can comprise a throat portion and a frame portion. The frame portion can be upwardly canted with respect to the throat portion, when viewed from a side elevation.

DETAILED DESCRIPTION OF THE INVENTION

Figure 1:
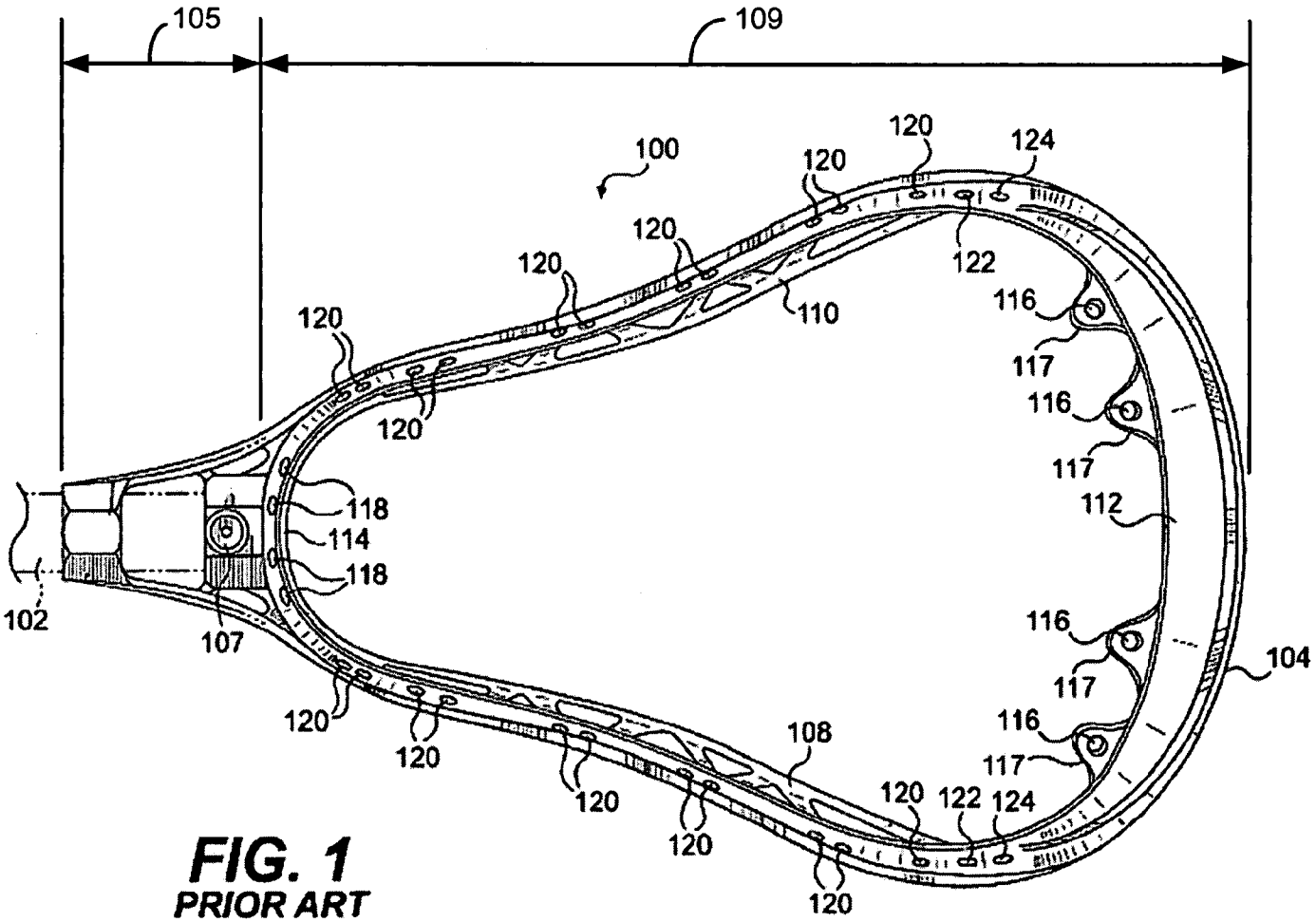
FIG. 1 PRIOR ART
FIG. 1 is a schematic diagram of a lacrosse stick.
Figure 2A:
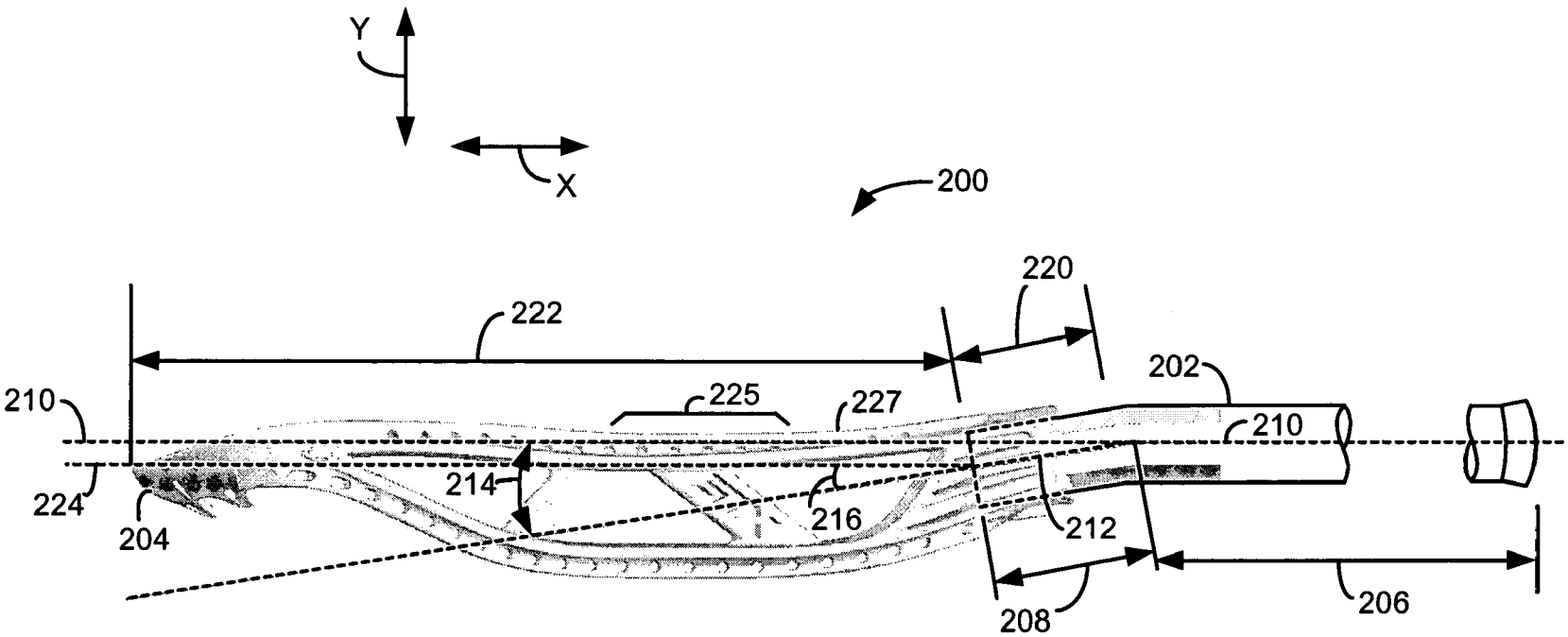
FIG. 2A is a schematic diagram illustrating a side elevation view of an exemplary lacrosse stick having a downwardly canted handle and an upwardly canted head, according to an embodiment of the present invention.

FIG. 2A illustrates a lacrosse stick 200 according to an embodiment of the present invention. As shown, lacrosse stick 200 includes a handle 202 and a head 204. Handle 202 includes a main portion 206 and a dowel portion 208. Handle 202 is downwardly canted in that dowel portion 208 departs from the axis 210 of main portion 206 in a downward direction below the main portion axis 210 when viewed from a side elevation as shown in FIG. 2A. In this manner, the main portion axis 210 and the axis 212 of dowel portion 208 are at an angle 214 to each other. This angle 214 is measured counterclockwise from main portion axis 210 to dowel portion axis 212 as shown in FIG. 2A. Angle 214 can range from greater than 0 degrees to about 90 degrees, but is, in one implementation, within a range of approximately 3 degrees to approximately 25 degrees. Main portion 206 can be longer than dowel portion 208, and can provide the principal structure by which a player holds lacrosse stick 200.

Head 204 includes a throat portion 220 and a frame portion 222. Throat portion 220 receives dowel portion 208 of handle 202. In this example, throat portion 220 provides a collar inside of which dowel portion 208 is disposed and a male plug (not shown) that is disposed within dowel portion 208. The axis of throat portion 220 can be coaxial with the dowel portion axis 212.

As shown in FIG. 2A, head 204 is upwardly canted in that frame portion 222 departs from throat portion 220 in an upward direction. In one aspect of the invention, frame portion 222 is upwardly canted with respect to the throat portion 220 at a point roughly between the frame portion 222 and the throat portion 220. For example, this point could correspond to the uppermost edge of head 204 directly above the end of the dowel portion 208 opposite main portion 206.

In another aspect of the invention, frame portion 222 is upwardly canted with respect to the throat portion 220 at a point roughly corresponding to the uppermost edge of head 204 directly above the stop member of head 204. At this location above the stop member, the sidewalls could cant upward relative to the stop member.

In another aspect of the invention, the upward canting between frame portion 222 and throat portion 220 occurs at a location more forward (i.e., toward the scoop) in the head 204. FIG. 2A illustrates this aspect, with a gradual canting occurring at approximately the area of point 227.

In another aspect of the invention, head 204 is upwardly canted in that the axis 224 of frame portion 222 departs from the axis 212 of throat portion 220 in an upward direction when viewed from a side elevation as shown in FIG. 2A. In this manner, the frame portion axis 224 and the throat portion axis 212 are at an angle 216 to each other. This angle 216 is measured counterclockwise from frame portion axis 224 to throat portion axis 212 as shown in FIG. 2A. Angle 216 can range from greater than 0 degrees to about 90 degrees, but is, in one implementation, within a range of approximately 3 degrees to approximately 25 degrees.

According to this aspect of the invention, the frame portion axis 224 can be defined as a line starting from the midpoint of the end of the dowel portion of the shaft and extending roughly parallel to the upper and lower edges of the sidewalls, at a region of the sidewalls at which the upper and lower edges of the sidewalls are roughly parallel (e.g., in area 225). In the configuration of FIG. 2A, in extending roughly parallel to the sidewall edges, axis 224 extends roughly parallel to the main portion axis 210. In alternative configurations, however, the sidewall edges and the frame portion axis 224 may not be roughly parallel to the main portion axis 210 and could, for example, rise in a direction from the throat portion 220 to the scoop of the head 204.

Alternatively, the frame portion axis 224 can be defined as a line drawn from the midpoint of the end of the dowel portion to the uppermost edge of the scoop. In the configuration of FIG. 2A, under this definition, the frame portion axis 224 is roughly parallel to the main portion axis 210. In alternative configurations, however, a frame portion axis 224 under this definition may not be roughly parallel to the main portion axis 201 and could, for example, rise in a direction from the throat portion 220 to the scoop of the head 204.

Figure 3:
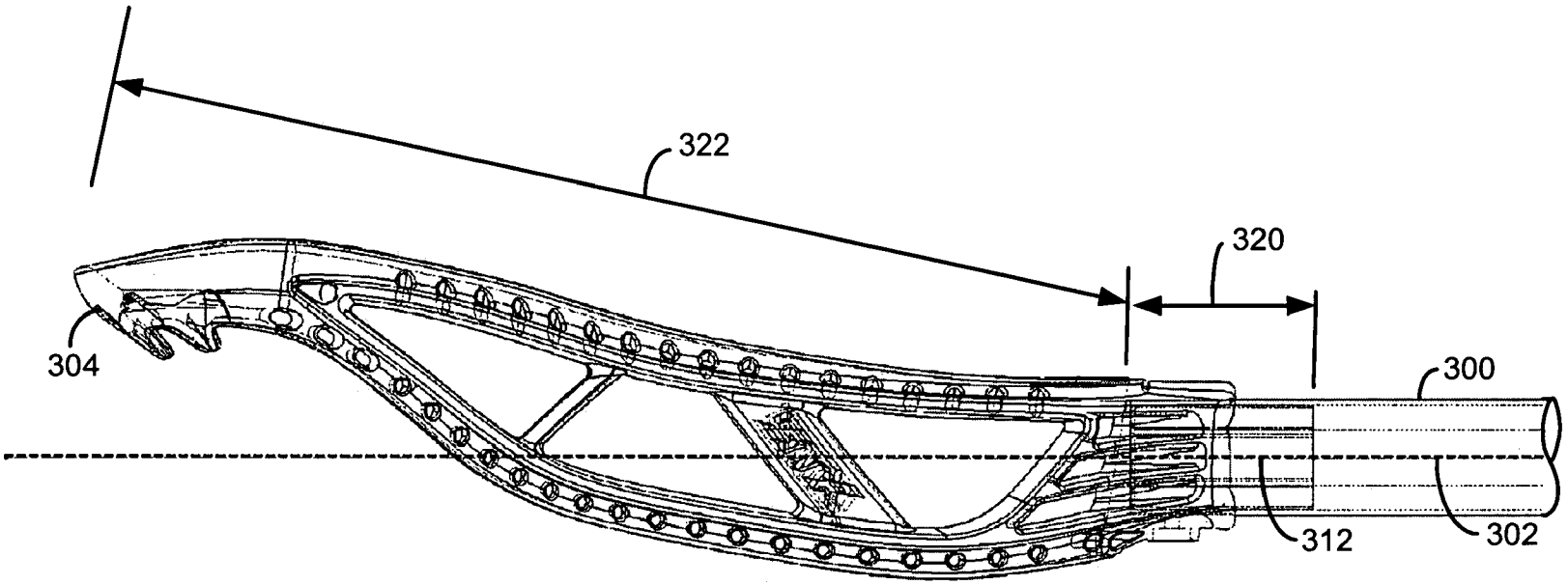
FIG. 3 is a schematic diagram illustrating an exemplary upwardly canted head that is similar to the head of FIG. 2A and is attached to a straight handle.

To better illustrate the canting of the frame portion 222 with respect to the throat portion 220 in head 204, FIG. 3 illustrates an exemplary upwardly canted head 304 that is similar to head 204 of FIG. 2A and is attached to a straight handle 300. As the straight handle 300 highlights, the frame portion 322 of head 304 rises from the throat portion axis 312, which in this case is coincidental with the axis 302 of straight handle 300. This view shows that the frame portion 322 is at an angle to the throat portion 320.

Referring again to FIG. 2A, the angle by which frame portion axis 224 is canted from the throat portion axis 212 determines the placement and alignment of the frame portion 222 with respect to the main portion 206 of the handle 202. In the example of FIG. 2A, because the main portion axis 210 is roughly parallel to the frame portion axis 224, the angle 214 by which the handle is downwardly canted is approximately equal to the angle 216 by which the head is upwardly canted. In other words, angles 214 and 216 are corresponding angles. Although shown as roughly parallel in FIG. 2A, the frame portion axis 224 and the main portion axis 210 do not have to be roughly parallel, in which case angles 214 and 216 would not be equal.

In one embodiment of the present invention, the angle 216 cants the frame portion 222 sufficiently upward such that the upper edges of the sidewalls of the head 204 are at or above the main portion axis 210, as that axis is extended through the head 204 as shown in FIG. 2A. At the same time, the scoop of lacrosse head 204 can be disposed below main portion axis 210, as is shown in FIG. 2A. In addition, the upper edge of the sidewalls of head 204, when viewed from a side elevation, can be substantially parallel to the main portion axis 210 along a portion of the sidewalls. In FIG. 2A, the upper edges of the sidewalls are roughly parallel to main portion axis 210 along a length 225 of the sidewalls between the scoop and the throat portion. In this same area 225, the upper and lower edges of the sidewalls are roughly parallel.

Figure 2B:
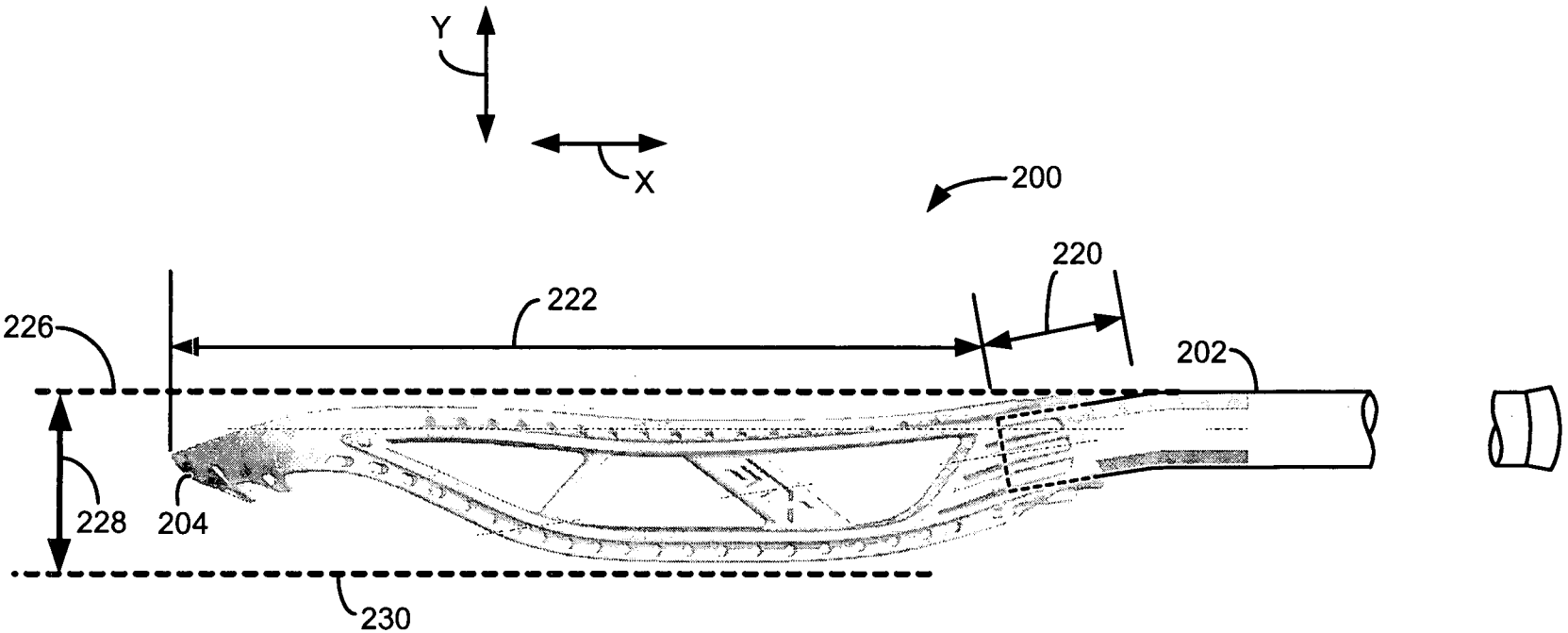
FIG. 2B is a schematic diagram illustrating the head of FIG. 2A with respect to a line drawn parallel to a line corresponding to the upper face of the handle at a certain distance between the two lines.

As shown in FIG. 2B, in another embodiment of the present invention, the angle 216 cants the frame portion 222 sufficiently upward such that no portion of head 204 extends below a line 230 drawn parallel to a line 226 corresponding to the upper face of handle 202 at a certain distance 228 between lines 226 and 230. Commonly accepted rules of lacrosse dictate this distance 228. For example, the men's lacrosse rules promulgated by the National Collegiate Athletic Association (NCAA) currently set this distance 228 at about 2.75 inches.

Figure 4:
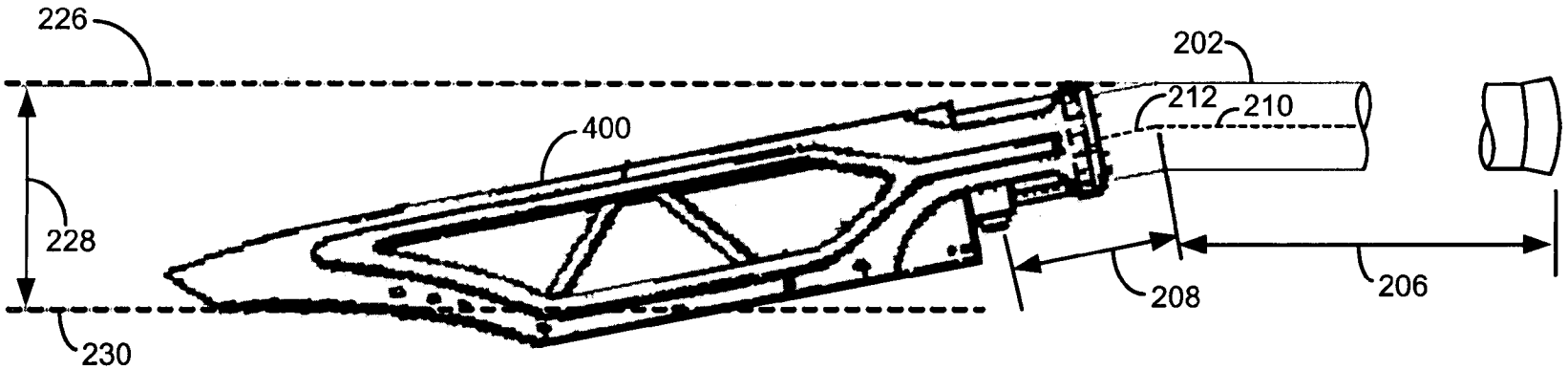
FIG. 4 is a schematic diagram illustrating the downwardly canted handle of FIG. 2A attached to a straight head.
Figure 5:
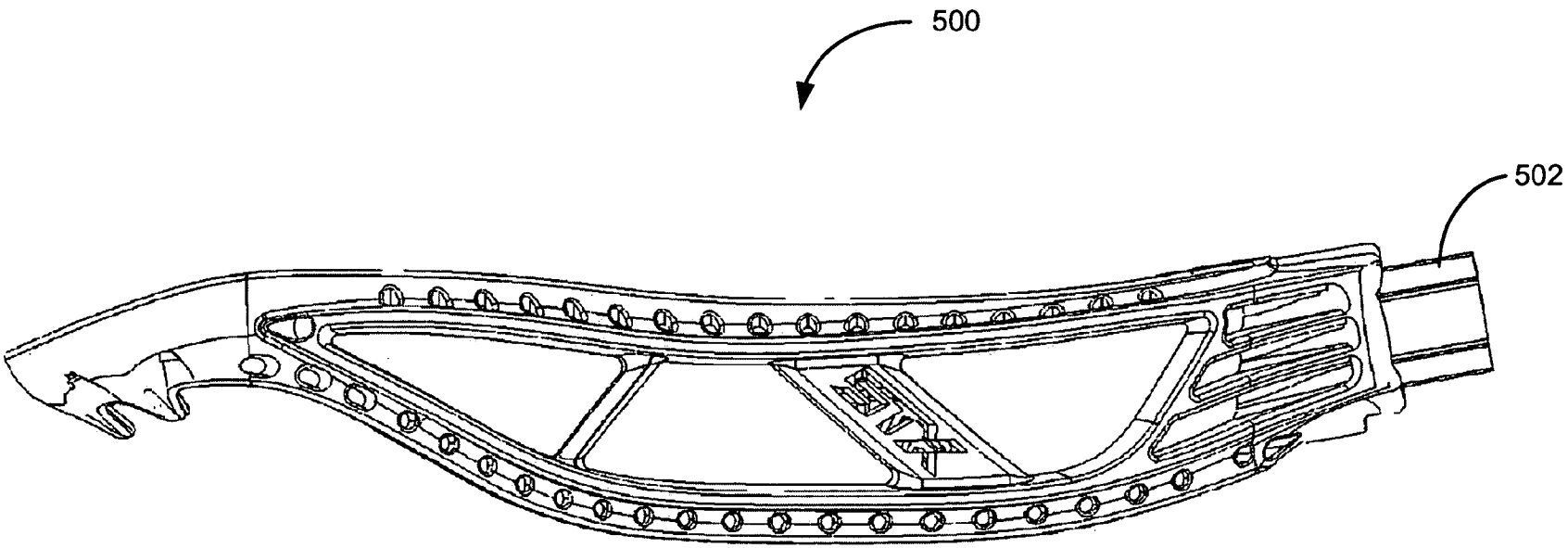
FIG. 5 is a schematic diagram of a side view of an exemplary upwardly canted lacrosse head facing a sidewall of the head, according to an embodiment of the present invention.
Figure 6:
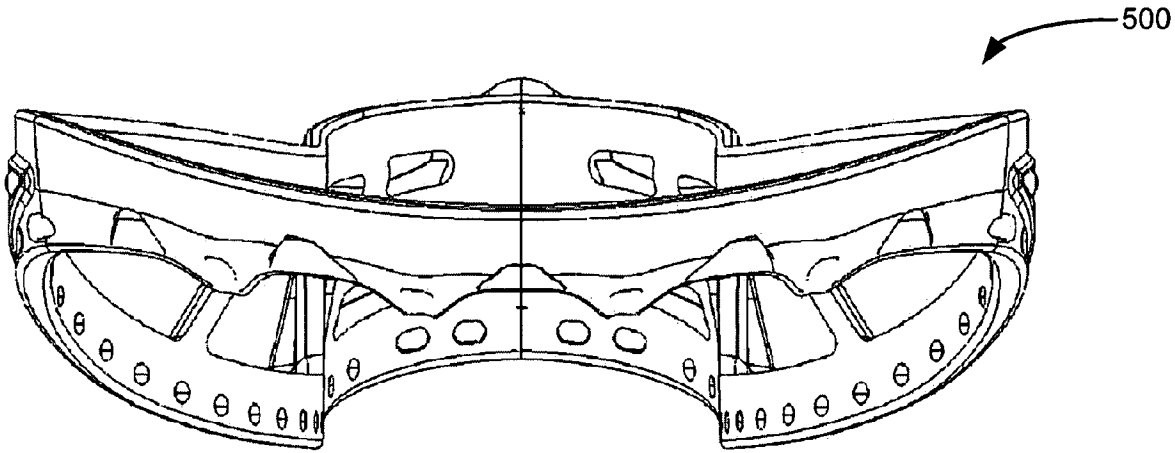
FIG. 6 is a schematic diagram of a side view of the lacrosse head of FIG. 5 facing the scoop of the head.
Figure 7:
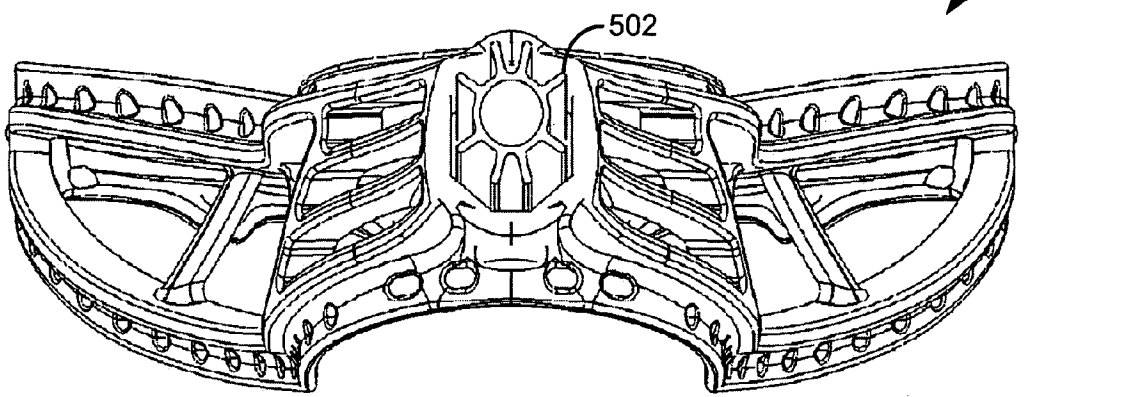
FIG. 7 is a schematic diagram of a side view of the lacrosse head of FIG. 5 facing the throat.
Figure 8:
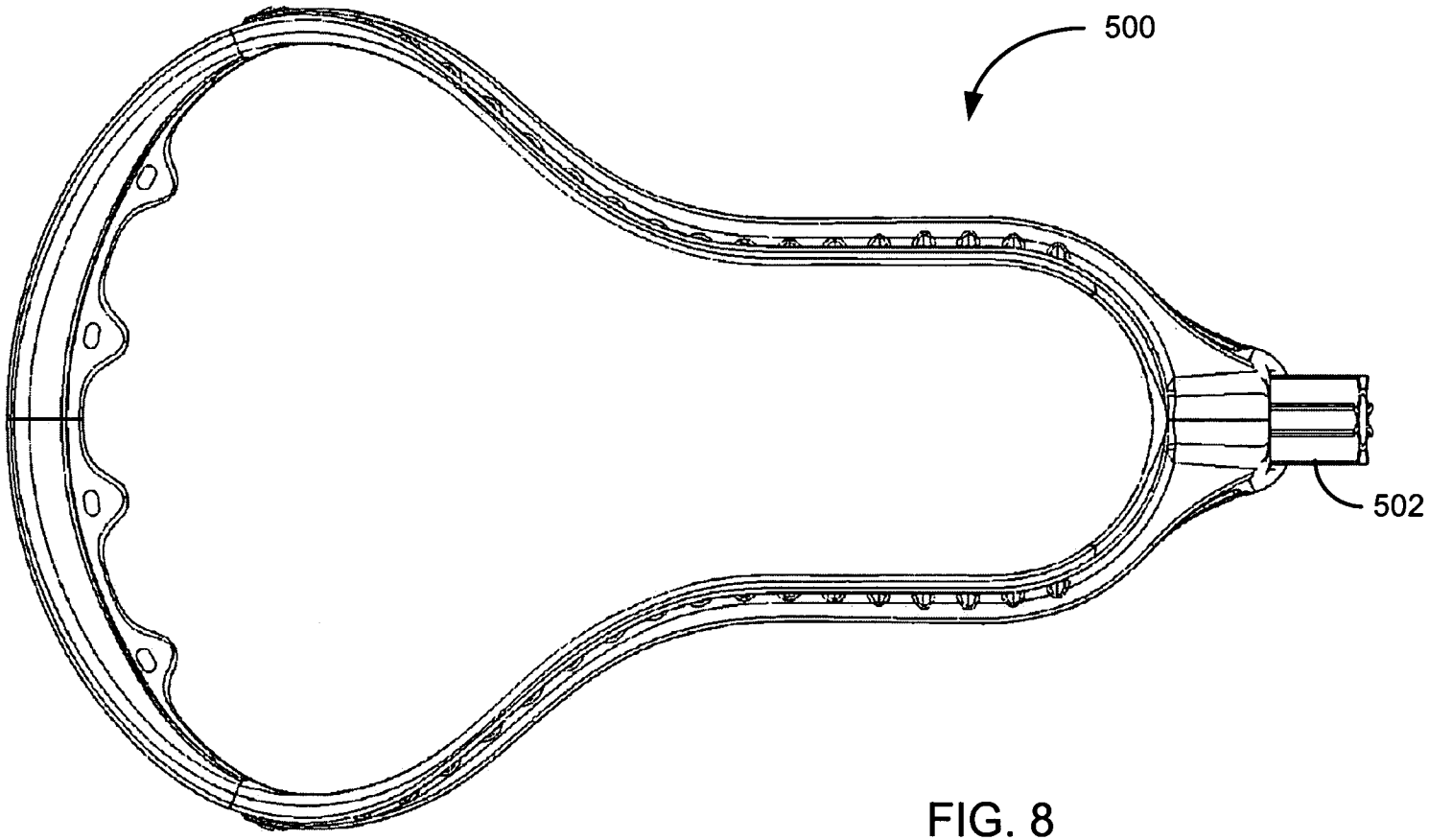
FIG. 8 is a schematic diagram of a plan view of the lacrosse head of FIG. 5 looking at the front face of the head.

By using a downwardly canted handle in conjunction with an upwardly canted head, the head can be offset closer to the limits of distance 228 (i.e., line 230) than has previously been possible. Indeed, if an ordinary straight head or offset head were attached to a canted handle of the present invention, the head would be disposed downward and well outside the distance 228. FIG. 4 demonstrates this point, showing a straight head 400 mounted on the exemplary canted handle 202 of FIG. 2A, with the head 400 disposed outside distance 228. In the present invention, however, the combination of the downwardly canted handle and the upwardly canted head enables not only the lowering of the head (e.g., the sidewalls of head 204 are below the line 226), but also the proper location and alignment of the lower portions of the sidewalls so that the head remains within the distance 228. In essence, the downward cant of the handle lowers the upper edges of the head and the upward cant of the head keeps the lower portions of the head (e.g., lower edge of sidewalls) within distance 228.

In downwardly canting the handle and upwardly canting the head, one of ordinary skill in the art would appreciate the interplay between the chosen angles 214 and 216, and the effects that certain dimensions may have on achieving a maximum lowering of the head that still complies with the applicable rules. For example, the length of the throat portion 220 of head 204 and the dowel portion 208 of handle 202, along with angles 214 and 216, can affect the positioning of head 204.

In one implementation that complies with the NCAA 2.75 inch rule, dowel portion 208 is approximately 2 inches, angles 214 and 216 are approximately 10 degrees, the maximum height of the throat and sidewalls is about 2 inches, and the length of head 204 is about 11 inches including throat portion 220 and frame portion 222. In other implementations, angle 214 is within a range of approximately 3 degrees to approximately 25 degrees and the length of the dowel portion 208 is within a range of approximately 1 to approximately 5 inches. With a longer dowel portion 208, the angle 214 could be smaller. For example, if the dowel portion 208 and main portion 206 are roughly equal in length (e.g., the cant is at the center of the handle), then angle 214 is slight. Varying these angles and lengths could provide lacrosse sticks with different feel and performance characteristics, as desired.

In addition, although FIG. 2A illustrates a handle 202 and head 204 in which a first portion departs linearly from the axis of a second portion (e.g., dowel portion axis 212 departs linearly from main portion axis 210), one of ordinary skill in the art would appreciate that the first portion could depart from the second portion along a curve. For example, instead of having linear portions 208 and 206 abutted to each other as is shown in FIG. 2A, handle 202 could have a curved transition in between the linear portions 208 and 206 that transitions main portion axis 210 into dowel portion axis 212. Likewise, head 204 could include a curved portion that transitions throat portion axis 212 into frame portion axis 224.

Figure 2C:
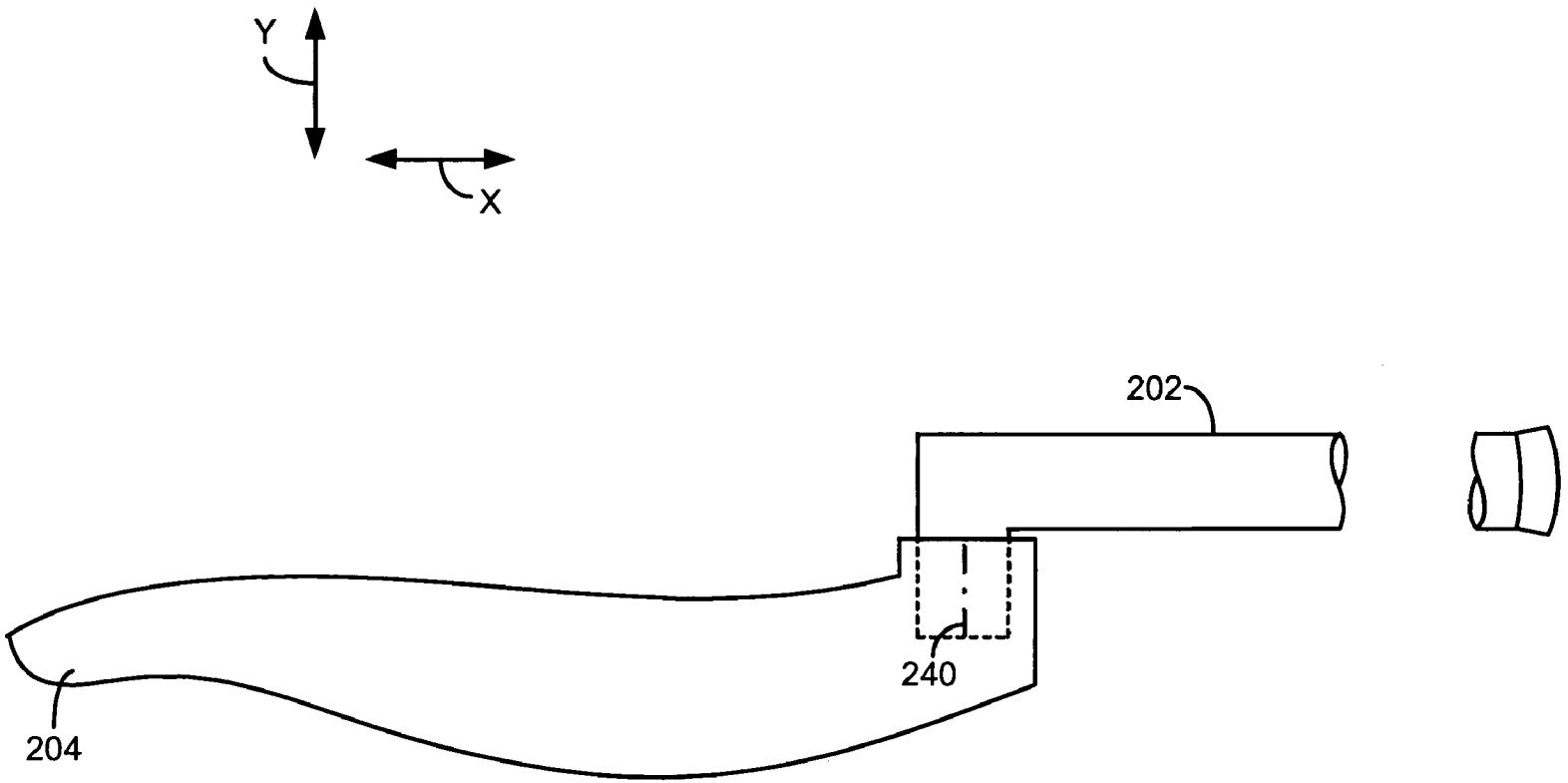
FIG. 2C is a schematic diagram illustrating a side elevation view of another exemplary lacrosse stick having a downwardly canted handle and an upwardly canted head, according to another embodiment of the present invention.

In an embodiment of the present invention, in which the angles 214 and 216 are approximately 90 degrees, the dowel portion axis 212 and the throat portion axis 212 are essentially vertical in FIG. 2A. In this configuration, dowel portion 208 could be disposed, for example, in a hole defined by throat portion 220, with the axis 240 of the hole roughly parallel to the y-axis shown in FIG. 2A. FIG. 2C illustrates this embodiment of the present invention. As another example, dowel portion 208 could be connected to a male plug protruding from throat portion 220, with the axis of the male plug roughly parallel to the y-axis shown in FIG. 2A, and with the male plug disposed in the bore of dowel portion 208. As another example, throat portion 220 could define both a gap and a male plug that connect to the dowel portion 208 as shown in FIG. 2A, with the axes of the gap and the male plug roughly parallel to the y-axis shown in FIG. 2A, and with the wall of the dowel portion 208 disposed in the gap and the male plug disposed in the bore of the dowel portion 208.

The downwardly canted handle and upwardly canted head of the present invention lower the center of mass of the head in the y-direction (see FIG. 2A) to provide a lowered head feel for orientation. At the same time, the gradual lowering of the head provided through the cants in the handle and head place a ball in the pocket further forward in the head when shooting and passing. Moreover, as described above in reference to line 230 of FIG. 2B, the canted handle and head enable the head to be precisely lowered and oriented up to the maximum distance allowable under commonly accepted rules of lacrosse (e.g., about 2.75 inches).

The lowered center of mass and the forward placement of the ball provide a better-playing lacrosse stick. By gradually canting the handle, the head throat portion, and the head frame portion towards the cradling, throwing, and receiving part of the net, the shooting and passing capabilities of the stick improve because the ball naturally comes to rest more forward in the head in comparison to conventional canted or offset heads. This gradual cant through the handle and head is preferable to a more severe offset of the sidewalls, which can impede passing and shooting. In this manner, the downwardly canted handle and upwardly canted head of the present invention can lower the head over a longer distance with a more gradual slope from the main portion axis 210 of the handle 202.

Tests have been conducted to compare the y-direction center of mass of conventional lacrosse sticks to an exemplary stick according to the present invention. In these tests, the plane of the handle and the plane of the bottom edge of the sidewalls were kept the same in all of the sticks. The center of mass of each stick was determined with the shaft parallel to the x-axis. Three types of conventional lacrosse sticks were tested: (1) a conventional straight sidewall and straight handle stick (e.g., STX Excalibur™); (2) a conventional lowered head stick using an abrupt offset sidewall head and straight handle (e.g., Brine Edge™); and (3) a conventional lowered head stick using a canted offset head and a straight handle (e.g., STX Proton +™). These tests showed that a stick having a canted handle and head of the present invention had a y-direction center of mass lower than the conventional straight sidewall and straight handle stick, and roughly equal to the y-direction centers of mass of the abrupt offset sidewall head and the canted offset head.

Assuming all other lacrosse head variables to be equal (e.g., pocket depth and sidewall openings), the center of mass in the y-direction can dictate the extent to which a player feels the ball in the head and how readily the ball releases from the head when passed or shot. With a straight sidewall head and handle, a player can experience very little feel for the ball in the head, as the center of mass in the y-direction is located toward the upper rails of the sidewall and is more in the same plane as the player's hands when gripping a handle. In this configuration, however, the ball can release very quickly out of the straight head and handle stick due to the shorter distance the ball must travel and the mid-head position that the ball assumes.

In the present invention, a player experiences more feel for the ball in comparison to a straight head and handle stick because the center of mass in the y-direction for the present invention is located more toward the bottom rail. At the same time, the present invention enables a forward ball position, in which the ball rests closer to the scoop. This forward ball position improves feel for the ball and release of the ball from the pocket. Such characteristics provide a lacrosse stick with superior ball handling and throwing capabilities.

FIGS. 5-8 illustrate an exemplary lacrosse head 500 according to an embodiment of the present invention. In this example, the lacrosse head 500 has a 10 degree cant (corresponding to angle 216 of FIG. 2A) and is adapted to connect to a handle (not shown) having a 2 inch dowel portion (corresponding to dowel portion 208 of FIG. 2A). The lacrosse head 500 also includes a male plug 502 adapted to be disposed within a handle.

Although some of the figures illustrate embodiments of the present invention having roughly octagonal-shaped handles, it should be understood that a lacrosse stick according to the present invention could be adapted to fit any variety of shaft shapes, such as teardrop, asymmetrical, and oval. Indeed, the lacrosse stick of the present invention could be adapted to accommodate a cylindrical shaft or a shaft having any number of sides.

Examples of suitable materials for a lacrosse head according to the present invention include nylon, composite materials, elastomers, metal, urethane, polycarbonate, polyethylene, polypropylene, polyketone, polybutylene terephalate, acetals (e.g., Delrin™ by DuPont), acrylonitrile-butadiene-styrene (ABS), acrylic, acrylic-styrene-acrylonitrile (ASA), alcryn (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), and polyvinyl chloride (PVC).

Examples of suitable materials for a handle according to the present invention include wood, metal (e.g., aluminum, titanium, scandium, CU31, C405, and C555), plastic, and composites. Methods for manufacturing the handle can include welding the dowel portion to the main portion, hot or cold forming a bend or curve into the handle, molding material to form the handle, sintering particles to form the handle, extruding the handle with a bend or curve, and laying up composite materials in the desired shape.

In one implementation of the present invention, a handle is formed by rotary-draw cold bending, in which material (e.g., tube) is drawn around a rotating bend form without heating. The forward-tangent of the material is clamped to the bend die and is drawn around the die as it rotates, while the back tangent is held in place against the rotating bend die by a pressure die. Thus, the point of contact between the rotating bend die and the pressure die is the line of tangency. What distinguishes rotary-draw bending from other methods is that this line of tangency is fixed in space. Therefore, mandrel and wiper tooling can be fixtured at the point of bend to fully control the flow of material. This control helps to produce tube bends of superior quality.

In another implementation of the present invention, a handle is formed by press bending, sometimes referred to as vertical bending. Press bending is distinguished from rotary-draw bending by the fact that when the ram die (analogous to the bend die in rotary-draw bending) pushes the tube through a pair of wing dies (analogous to the pressure die in rotary-draw bending), two lines of tangency form following the points of contact between the circumference of the ram die and each face of the two wing dies.

In another implementation of the present invention, a handle is formed by hydroforming. Hydroforming uses fluid pressure in place of a punch in a conventional tool set to form the part into the desired shape of the die. This technique is very useful for producing whole components that would otherwise be made from multiple stampings joined together.

In another implementation of the present invention, a handle is formed by hot bending or hot forming. In this method of bending, the ductility of the tubing material is increased by heating it either before placement on the machine or in-process. Usually, in-process heating of the material is done indirectly, e.g., with heating elements fixtured in the tools so that the material is heated by conduction through the tools.

Although embodiments of the present invention describe exemplary lacrosse sticks having handles attached to heads by female and/or male mechanical connections and with screws or other fasteners, one of ordinary skill in the art would appreciate that the present invention is equally applicable to unitary lacrosse sticks. For example, the entire handle and head could be formed as one piece, from laid-up composite materials, similar to methods by which some tennis racquets are manufactured. For this reason, the present invention should not be limited to lacrosse sticks assembled from separate components.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A lacrosse stick comprising:

a handle comprising a main portion and a dowel portion, the main portion having a main portion axis and the dowel portion having a dowel portion axis, and the dowel portion axis being disposed downwardly at a first angle to the main portion axis, when viewed from a side elevation, the handle ending along the dowel portion axis at an end of the dowel portion; and a head comprising a throat portion and a frame portion, the frame portion upwardly canted with respect to the throat portion, when viewed from a side elevation, the throat portion of the head defining a socket that receives all or part of the dowel portion of the handle, the frame portion comprising a stop member, a first sidewall, a second sidewall, and a scoop connected to the first sidewall and the second sidewall opposite to the stop member, the head positioned such that no portion of the first sidewall and no portion of the second sidewall, when viewed from a face-up side elevation, is disposed below a line drawn parallel to and 2.75 inches below a tabletop line corresponding to a tabletop surface on which the lacrosse stick would rest if face down, the upward cant of the frame portion with respect to the throat portion starting along the upper edges of the first and second sidewalls at a location that is within approximately three inches from the end of the dowel portion when viewed from a side elevation and measured in a direction parallel to the dowel portion axis, the upward cant comprising an increase in the distance between the upper edges and the dowel portion axis measured perpendicularly to the dowel portion axis when viewed from a side elevation, the throat portion having a throat portion axis that is coincidental with the dowel portion axis, the frame portion having a frame portion axis that is disposed upwardly at a second angle to the throat portion axis when the head is viewed from a side elevation, and the frame portion axis comprising a line drawn from the midpoint of the end of the dowel portion axis and extending substantially parallel to an upper edge and a lower edge of the first sidewall along a portion of the length of the first sidewall, when viewed from a side elevation.

2. The lacrosse stick of claim 1, the first angle measured counterclockwise from the main portion axis to the dowel portion axis when viewed from a side elevation with the head to the left of the handle, and the first angle being within a range of approximately 3 degrees to approximately 25 degrees.

3. The lacrosse stick of claim l, the dowel portion being within a range of approximately 1 inch to approximately 5 inches in length.

4. The lacrosse stick of claim 1, at least a portion of the first sidewall and at least a portion of the second sidewall remaining above the main portion axis for substantially the entire length of the two sidewalls, when viewed from a side elevation.

5. The lacrosse stick of claim 4, the upper surface of the forwardmost point of the scoop being disposed below the main portion axis.

6. The lacrosse stick of claim 1, the throat portion comprising a male plug disposed within the dowel portion of the handle.

7. The lacrosse stick of claim 1, the throat portion having a throat portion axis that is coincidental with the dowel portion axis, the frame portion having a frame portion axis that is disposed upwardly at a second angle to the throat portion axis when the head is viewed from a side elevation, and the frame portion axis comprising a line drawn from a first point at the intersection of the dowel portion axis and the end of the dowel portion to a second point at the upper surface of the forwardmost point of the scoop, when viewed from a side elevation.

8. The lacrosse stick of claim 7, the first angle measured counterclockwise from the main portion axis to the dowel portion axis when viewed from a side elevation with the head to the left of the handle, the second angle measured counterclockwise from the frame portion axis to the throat portion axis when viewed from a side elevation with the head to the left of the handle, and the first angle and second angle being equal.

9. The lacrosse stick of claim 7, the main portion axis and the frame portion axis being substantially parallel.

10. The lacrosse stick of claim 7, the first angle measured counterclockwise from the main portion axis to the dowel portion axis when viewed from a side elevation with the head to the left of the handle, the second angle measured counterclockwise from the frame portion axis to the throat portion axis when viewed from a side elevation with the head to the left of the handle, the first angle and the second angle being approximately 10 degrees, and the dowel portion being approximately 2 inches in length.

11. The lacrosse stick of claim 7, the upper surface of the forwardmost point of the scoop being disposed below the main portion axis.

12. The lacrosse stick of claim 1, the main portion axis and the frame portion axis being substantially parallel.

13. The lacrosse stick of claim 1, the upper surface of the forwardmost point of the scoop being disposed below the main portion axis.

14. The lacrosse stick of claim 1, the handle further comprising a curved portion that transitions the main portion into the dowel portion.

15. The lacrosse stick of claim 1, the lacrosse stick comprising a unitary lacrosse stick.

16. The lacrosse stick of claim 1, the upward cant of the frame portion with respect to the throat portion occurring approximately above the end of the dowel portion.

17. The lacrosse stick of claim 1, the upward cant of the frame portion with respect to the throat portion occurring approximately at a point corresponding to the uppermost edge of the head above the stop member.

18. The lacrosse stick of claim 1, at least a portion of the first sidewall and the second sidewall not being concave with respect to an interior of the frame portion when the head is viewed from a plan view.

19. A lacrosse stick comprising:

a handle comprising a main portion and a dowel portion, the main portion having a main portion axis and the dowel portion having a dowel portion axis, and the dowel portion axis being disposed at an angle to the main portion axis, the handle ending along the dowel portion axis at an end of the dowel portion; and a head comprising a throat portion defining a socket that receives all or part of the dowel portion of the handle, the throat portion having an axis that is coincidental with the dowel portion axis, a first sidewall connected to the throat portion, the first sidewall having a first sidewall upper edge when viewed from a first side elevation, a second sidewall connected to the throat portion, the second sidewall having a second sidewall upper edge when viewed from a second side elevation, a scoop connected to the first sidewall and the second sidewall opposite to the throat portion, the first sidewall upper edge and the second sidewall upper edge being disposed closer to the dowel portion axis in an area proximate to the throat portion than in an area proximate to the scoop, when the head is viewed from the respective first and second side elevations, the head positioned such that no portion of the first sidewall and no portion of the second sidewall, when viewed from a face-up side elevation, is disposed below a line drawn parallel to and 2.75 inches below a tabletop line corresponding to a tabletop surface on which the lacrosse stick would rest if face down, the upper edges of the first sidewall and the second sidewall starting an upward cant with respect to the throat portion at a location that is within approximately three inches from the end of the dowel portion when viewed from a side elevation and measured in a direction parallel to the dowel portion axis, the upward cant comprising an increase in the distance between the upper edges and the dowel portion axis measured perpendicularly to the dowel portion axis when viewed from a side elevation, and the first sidewall upper edge and the second sidewall upper edge being disposed above the main portion axis for the entire distance from the area proximate to the throat portion to the area proximate to the scoop.

20. The lacrosse stick of claim 19, the distance between the upper edges and the dowel portion axis continually increasing from the upward cant in a direction from the throat portion to the scoop, when viewed from a side elevation.

21. The lacrosse stick of claim 19, the first sidewall upper edge and the second sidewall upper edge being substantially parallel to the main portion axis along a portion of the length of the sidewalls.

22. The lacrosse stick of claim 19, the upper surface of the forwardmost point of the scoop being disposed below the main portion axis.

23. A lacrosse stick comprising:

a handle comprising a main portion and a dowel portion, the main portion having a main portion axis and the dowel portion having a dowel portion axis, and the dowel portion axis being disposed at an angle to the main portion axis such that the dowel portion is downwardly canted with respect to the main portion when viewed from a side elevation, the handle ending along the dowel portion axis at an end of the dowel portion, the dowel portion being within a range of approximately 1 inch to approximately 5inches in length, and the angle being within a range of approximately 3 degrees to approximately 25 degrees when measured counterclockwise from the main portion axis to the dowel portion axis when viewed from a side elevation with the head to the left of the handle; and a head comprising a throat portion defining a socket that receives all or part of the dowel portion of the handle, the throat portion having an axis that is coincidental with the dowel portion axis, and two sidewalls connected to the throat portion, the two sidewalls upwardly canted along their upper edges with respect to the throat portion when viewed from a side elevation such that:

the distance between the upper edges and the dowel portion axis as measured perpendicularly to the dowel portion axis does not decrease as the two sidewalls extend away from the dowel portion, at least a portion of each of the two sidewalls remains approximately at or above the main portion axis for substantially the entire length of the two sidewalls, and the throat portion including a stop member, the two sidewalls upwardly canted with respect to the throat portion approximately at a point corresponding to the uppermost edge of the head above the stop member.

24. The lacrosse stick of claim 23, the upper edges being substantially parallel to the main portion axis along a portion of the length of the sidewalls.

25. The lacrosse stick of claim 23, the head positioned such that no portion of the two sidewalls, when viewed from a face-up side elevation, is disposed below a line drawn parallel to and 2.75 inches below a tabletop line corresponding to a tabletop surface on which the lacrosse stick would rest if face down.

26. The lacrosse stick of claim 23, the head further comprising a scoop connecting the two sidewalls on their ends opposite the throat portion, the upper surface of the forwardmost point of the scoop disposed below the main portion axis.

27. The lacrosse stick of claim 23, at least a portion of the two sidewalls not being concave with respect to an interior of the frame portion when the head is viewed from a plan view.

* * * * *